US009398386B2

(12) United States Patent
Boretzki et al.

(10) Patent No.: US 9,398,386 B2
(45) Date of Patent: Jul. 19, 2016

(54) METHOD FOR REMOTE FITTING OF A HEARING DEVICE

(75) Inventors: Michael Boretzki, Ruti (CH); Harald Krueger, Affoltern am Albis (CH); Stefan Launer, Zurich (CH)

(73) Assignee: SONOVA AG, Staefa (CH)

( * ) Notice: Subject to any disclaimer, the term of this patent is extended or adjusted under 35 U.S.C. 154(b) by 139 days.

(21) Appl. No.: 13/984,357

(22) PCT Filed: Feb. 9, 2011

(86) PCT No.: PCT/EP2011/051899
§ 371 (c)(1),
(2), (4) Date: Aug. 8, 2013

(87) PCT Pub. No.: WO2012/107085
PCT Pub. Date: Aug. 16, 2012

(65) Prior Publication Data
US 2013/0322669 A1 Dec. 5, 2013

(51) Int. Cl.
*H04R 25/00* (2006.01)
*H04R 29/00* (2006.01)

(52) U.S. Cl.
CPC ..... *H04R 25/70* (2013.01); *H04R 25/30* (2013.01)

(58) Field of Classification Search
CPC ..... H04R 25/70; H04R 25/40; H04R 25/30; H04R 2225/55
USPC ..... 381/60, 312–321, 92; 700/94
See application file for complete search history.

(56) References Cited

U.S. PATENT DOCUMENTS

| | | | | |
|---|---|---|---|---|
| 6,912,289 | B2 * | 6/2005 | Vonlanthen et al. | 381/312 |
| 2003/0081115 | A1 * | 5/2003 | Curry | H04M 3/56 348/14.12 |
| 2005/0283263 | A1 * | 12/2005 | Eaton | H04R 25/554 700/94 |
| 2007/0269064 | A1 * | 11/2007 | Allegro-Baumann et al. | 381/313 |
| 2010/0104118 | A1 | 4/2010 | Sasidharan et al. | |
| 2011/0019846 | A1 | 1/2011 | Anderson | |
| 2011/0082520 | A1 * | 4/2011 | McElveen, Jr. | 607/57 |

FOREIGN PATENT DOCUMENTS

| | | | |
|---|---|---|---|
| WO | 00/22874 | A2 | 4/2000 |
| WO | 02/35884 | A2 | 5/2002 |
| WO | 2004/086816 | A1 | 10/2004 |

OTHER PUBLICATIONS

International Search Report for PCT/EP2011/051899 dated Jun. 28, 2012.
Written Opinion for PCT/EP2011/051899 dated Jun. 28, 2012.

* cited by examiner

*Primary Examiner* — Sunita Joshi
(74) *Attorney, Agent, or Firm* — Pearne & Gordon LLP

(57) ABSTRACT

The present invention proposes two alternative methods for remote fitting of one or two hearing devices (5, 5'), i.e. where a hearing device fitter (1) located in a first room (R1) provides remote support to a user (6) of the one or two hearing devices (5, 5') located in a distant second room (R2) in order to adjust the one or two hearing devices (5, 5') to the individual needs of the user (6). According to a first method a voice rendering signal processing is applied to the fitter's voice, thus achieving that the fitter's voice is perceived by the user (6) as if the user (6) were at a virtual user location (L) in the first room (R1) wearing the one or two hearing devices (5, 5'). The same is achieved according to a second, alternative method, wherein the fitter's voice is picked up by at least one or two microphones of one or two further hearing devices located at the virtual user location (L) at a first position (P1) and/or at a second position (P2).

20 Claims, 1 Drawing Sheet

METHOD FOR REMOTE FITTING OF A HEARING DEVICE

TECHNICAL FIELD

The present invention relates to the field of hearing devices and more specifically to methods for remote fitting of a hearing device, i.e. where a hearing device fitter, e.g. a hearing health care specialist such as an audiologist, provides remote support to a distant user of one or two hearing devices in order to adjust the hearing device(s) to the individual needs of the user.

BACKGROUND OF THE INVENTION

In the context of the present invention the term "hearing device" refers to hearing aids (alternatively called hearing instruments or hearing prostheses) used to compensate hearing impairments of hard of hearing persons as well as audio and communication devices used to provide sound signals to persons with normal hearing capability, e.g. in order to improve hearing in harsh acoustic surroundings. Hearing devices can be adapted to be worn at the ear, behind the ear or in the ear canal of a user, and for certain applications can also be anchored to or implanted into a user's head.

Hearing devices are normally adjusted to the individual needs of a user in a hearing device professional's office. This adjustment process is typically referred to as hearing device "fitting" and is usually performed by a trained specialist, such as for instance a hearing health care professional, e.g. a hearing device dispenser or an audiologist, who is commonly referred to as the "fitter". The term "fitting" usually encompasses both of the following two tasks. On the one hand the physical customisation of the hearing device to the geometry of the user's individual ear and/or ear canal, in order to provide a hearing device which is appropriately shaped and sized to assure good wearing comfort and optimal acoustic coupling. On the other hand the audio signal processing of the hearing device must be adapted such that it meets the specific needs and requirements of the user, e.g. to compensate the user's hearing deficiency to the best possible degree or to improve as much as possible his hearing capability in difficult listening situations. In the context of the present invention, we will be dealing with the latter issue of adjusting the settings associated with the processing performed by the hearing device. This processing will be referred to as "hearing loss compensation signal processing" within the context of the present invention, but this term is also meant to encompass "hearing improvement signal processing" as applied in a hearing device for a user with normal hearing capability, for instance to enhance his/her hearing capability in extreme acoustic circumstances.

Hearing device fitting is commonly a very cumbersome process, requiring multiple sessions with the fitter in order to fine tune the settings of the hearing device or hearing devices in the case of a "binaural fitting", i.e. when the user is equipped with a hearing device at both ears, to the user's specific needs and requirements. Fitting is therefore a very time consuming and costly undertaking. A possible solution to eliminate the cost and time involved for the user with having to travel to the fitter's office several times is to perform remote fitting, where the fitter is at his office and the user is located at a remote location, e.g. at home. To achieve this one or more communication links between the fitter and the user have to be established in order to enable both verbal communication between the fitter and the user as well as to possibly provide a means for programming the hearing device(s), e.g. to load new settings or a new software module into the memory of the hearing device(s).

A number of technical solutions for providing a link to a hearing device such that remote fitting becomes possible are known. In this respect reference is made to the following prior art publications. WO 00/22874 A2 discloses a fitting system for hearing devices where the input device is a mobile telephone. WO 02/35884 A2 discloses a method and system for remotely upgrading a hearing aid device by downloading software resources over a network from a remote server to a local client. WO 2004/086816 A1 discloses a system and a method for providing a talk-over functionality from an attendant located in one room to a hearing aid user located in another room.

However, a major problem of remote fitting is the lack of physical presence of the fitter, since the voice of the fitter plays the role of an acoustic benchmark with regard to loudness, timbre and intelligibility. In a remote fitting session where the fitter's voice is only provided via telephone or a telephone-like connection this kind of acoustic benchmark is effectively not available.

SUMMARY OF THE INVENTION

It is an object of the present invention to provide methods with which it is possible to perform remote fitting of one or two hearing devices such that the fitter's voice is perceived as naturally as possible by the distant user of the one or two hearing devices.

At least this object is achieved by two alternative methods according to claims 1 and 8. Preferred embodiments of the methods are given in the dependent claims.

A first method is proposed for fitting one or two hearing devices, wherein a fitter is in a first room and a user of said one or two hearing devices is in a second room being distant from said first room, and wherein in said first room there is a virtual user location at a distance in a range of 0.5 m to 5 m from said fitter, said method comprising the steps of:

- picking up a voice of said fitter in said first room;
- transmitting said voice of said fitter to said second room via a communication network;
- applying a hearing loss compensating signal processing to said voice of said fitter before and/or after said transmission thereby obtaining a hearing loss compensated version of said voice of said fitter;
- presenting said hearing loss compensated version of said voice of said fitter to said user in said second room;
- obtaining a feedback from said user, said feedback being indicative of how said hearing loss compensated version of said voice of said fitter was perceived by said user;
- transmitting said feedback to said first room via said communication network and presenting said feedback to said fitter;
- obtaining an adjustment instruction from said fitter;
- adjusting said hearing loss compensating signal processing according to said adjustment instruction;
- repeating the preceding steps until said fitter and/or said user is satisfied with said hearing loss compensating signal processing;

wherein a voice rendering signal processing is applied to said voice of said fitter before and/or after said transmission and before and/or after said hearing loss compensating signal processing, said voice rendering signal processing rendering said voice of said fitter such that it is perceived by said user as if said user were at said virtual user location wearing said one or two hearing devices.

In this way the loudness, timbre and intelligibility of the fitter's voice appears to the distant user of the hearing device(s) as if he/she were actually located at the fitter's site, thus effectively allowing to use the fitter's voice as an acoustic benchmark when fitting the hearing device(s).

In an embodiment of the proposed first method said picking up said voice of said fitter is performed at a position in close proximity to said fitter's mouth. By picking up the fitter's voice close to his mouth it is ensured that his voice dominates over possibly interfering sounds from the surroundings. However, since the fitter's voice is being picked up by a single microphone and thus providing only a mono signal to the user the perception of the fitter's voice by the user lacks directionality.

In another embodiment of the proposed first method said picking up said voice of said fitter is performed at said virtual user location at a first position where a first ear of said user would be if said user were present in said first room at said virtual user location and/or at a second position where a second ear of said user would be if said user were present in said first room at said virtual user location. In this way the impression can be created that the fitter's voice is coming from a specific direction which is dependent on the first and second positions relative to the location of the fitter. By providing this directionality the fitter's voice appears more natural to the user and thus the fitting process is more efficient and the resulting adjustments of the hearing loss compensating processing are more effective.

In a further embodiment of the proposed first method said picking up said voice of said fitter is performed by at least one or two microphones at said first and/or second position, the at least one or two microphones being located in a free field, on one or both sides of a Jecklin disk, or at or in one or both ears of a dummy head.

By placing the microphones on either side of a Jecklin disk or alternatively inset in ear-shaped moulds of a dummy head such as a KEMAR manikin the sound waves generated by the fitter's voice are captured more realistically by the microphones since the angle of incidence of and the time delay between different wave fronts is accurately taken into account. By employing a dummy head the frequency spectrum of the sound waves is adjusted according to the so-called head-related transfer functions (HRTFs) which take into account the way in which the sound waves are influenced by the human head and the form of the concha as well as the inlet into the ear canal. This is important in order to avoid inside-head localisation and thus achieve an externalisation of the fitter's voice.

In yet another embodiment of the proposed first method said voice rendering signal processing comprises applying at least one or two transfer functions selected from a multitude of transfer functions, said method further comprising the steps of:

measuring and/or calculating transfer functions for different hearing devices, acoustic couplings, distances between fitter and virtual user location and/or room acoustics;

storing said transfer functions in a database;

providing data from said database for use in said voice rendering signal processing.

In yet a further embodiment of the proposed first method said step of measuring and/or calculating transfer functions comprises one or more of the following sub-steps:

measuring a microphone location effect;

estimating an attenuation for a particular distance between fitter and virtual user location;

measuring a room acoustics, in particular by measuring an impulse response.

In the case where the fitter's voice is picked up with a single microphone arranged in close proximity to the fitter's mouth a transfer function is for instance applied to the microphone signal in order to generate the impression that the fitter's voice is being picked up at a distance from the fitter's mouth. The employed transfer function should then for instance take into account the attenuation of the microphone signal for a particular distance between fitter and a certain virtual microphone/user location, the room acoustics at the fitter's location and/or microphone location effects. By doing so the fitter's voice can be made to sound as if it had been picked up at a desired position located at a specific distance from the fitter. In order to provide a stereo signal to the user the microphone signal picked up at the fitter's mouth is applied to two transfer functions in order to generate two microphone signals associated with two virtual microphones located at two positions approximately spaced apart by the distance between the ears of the user. By doing so the fitter's voice is perceived more naturally since it appears to the user to be coming from a certain direction, i.e. an impression of directionality can be generated which is important in order to achieve a good fitting result.

In yet a further embodiment of the proposed first method said one or two hearing devices each comprises a rear and a front microphone, wherein one of the following applies:

said voice rendering signal processing comprises generating a first signal which replaces a front microphone signal derived from said front microphone and a second signal which replaces a rear microphone signal derived from said rear microphone, wherein said hearing loss compensating signal processing comprises a beam-forming processing;

said hearing loss compensating signal processing is operated in an omni-directional mode which does not differentiate between said front and rear microphone signals, at least whenever said voice of said fitter is presented.

Advanced hearing devices often have two microphones whose output signals are combined in order to achieve a desired directional gain pattern. This process is known as beam-forming. In order to fit such hearing devices according to the present invention various options are proposed. When picking up the fitter's voice with a single microphone four transfer functions are required in order to generate the front and rear microphone signals for both the left and right hearing devices of the user. All four signals can then for example be transmitted via the communication network to the user and applied as front and rear microphone signals to each of the left and right hearing devices, which them perform the beam-forming processing.

Alternatively, the beam-forming processing can already be performed prior to transmitting the signals such that only a single left and right beam-formed signal has to be transmitted to the user. The fitter's voice can also be picked up by two microphones, e.g. two omni-directional microphones, and the front and rear microphone signals can then be generated by applying appropriate filtering to the signals from the two omni-directional microphones. Then either the signals from the two omni-directional microphones, the generated front and rear microphone signals or two beam-formed signals can be transmitted to the user via the communication network, where in the second case the respective front and rear microphone signals are suitably combined.

In case beam-forming is not to be accounted for as part of the remote fitting procedure it is sufficient to transmit two microphone signals related to the left and right hearing devices of the user and to have the hearing loss compensating signal processing operate in an omni-directional mode, i.e. one acting on only a single microphone signal instead of combining a front and a rear microphone signal.

Moreover, a second, alternative method is proposed for fitting one or two hearing devices, wherein a fitter is in a first room and a user of said one or two hearing devices is in a second room being distant from said first room, and wherein in said first room there is a virtual user location at a distance in a range of 0.5 m to 5 m from said fitter, said method comprising the steps of:

picking up a voice of said fitter in said first room;

transmitting said voice of said fitter to said second room via a communication network;

applying a hearing loss compensating signal processing to said voice of said fitter before and/or after said transmission thereby obtaining a hearing loss compensated version of said voice of said fitter;

presenting said hearing loss compensated version of said voice of said fitter to said user in said second room;

obtaining a feedback from said user, said feedback being indicative of how said hearing loss compensated version of said voice of said fitter was perceived by said user;

transmitting said feedback to said first room via said communication network and presenting said feedback to said fitter;

obtaining an adjustment instruction from said fitter;

adjusting said hearing loss compensating signal processing according to said adjustment instruction;

repeating the preceding steps until said fitter and/or said user is satisfied with said hearing loss compensating signal processing;

wherein said picking up said voice of said fitter is performed by at least one or two microphones of one or two further hearing devices located at said virtual user location at a first position where a first of said one or two hearing devices being worn by said user would be if said user were present in said first room at said virtual user location and/or at a second position where a second of said one or two hearing devices being worn by said user would be if said user were present in said first room at said virtual user location.

In this way the loudness, timbre and intelligibility of the fitter's voice appears to the distant user of the hearing device(s) as if he/she were actually located at the fitter's site, thus effectively allowing to use the fitter's voice as an acoustic benchmark when fitting the hearing device(s), as is the case when employing the proposed first method. However, by picking up the fitter's voice with the microphone(s) of the further hearing device(s) at the virtual location of the user at the fitter's site no transfer functions need to be applied to the microphone signal(s) in order to realistically capture the fitter's voice. This is especially the case when the characteristics of the microphone(s) of the further hearing device(s) match those of the hearing device(s) of the user. Since for example only the microphone(s) of the further hearing device(s) is/are used but no processing of the microphone signal(s) is carried out in the further hearing device(s), the further hearing device(s) does/do not have to include a signal processing unit, i.e. the further hearing device(s) does/do not have to be identical to the hearing device(s) of the user and may only incorporate partial hearing device functionality.

In an embodiment of the proposed second method said one or two further hearing devices are at said first and/or second position located in a free field, on one or both sides of a Jecklin disk, or at or in one or both ears of a dummy head.

As with the proposed first method placing the microphones on either side of a Jecklin disk or alternatively inset in ear-shaped moulds of a dummy head such as a KEMAR manikin allows to generate a more natural impression of the fitter's voice to the user. This is especially the case when the coupling of the further hearing device(s) to the dummy head is essentially the same as the coupling of the hearing device(s) to the ear(s) of the user.

In another embodiment of the proposed second method said one or two hearing devices each comprises a front and a rear microphone, wherein one of the following applies:

said one or two further hearing devices each comprises a front and a rear microphone by which said voice of said fitter is picked up, wherein said hearing loss compensating signal processing comprises a beam-forming processing;

said one or two further hearing devices each comprises only one microphone by which said voice of said fitter is picked up, wherein a front and a rear microphone signal is simulated by an appropriate filtering, wherein said hearing loss compensating signal processing comprises a beam-forming processing;

said hearing loss compensating signal processing is operated in an omni-directional mode which does not differentiate between said front and rear microphone signals, at least whenever said voice of said fitter is presented.

In this way the beam-forming behaviour can be effectively fitted with a set-up utilising further hearing devices each having a front and rear microphone. To achieve this for instance all four microphone signals are transmitted to the user's site where they are applied to the corresponding hearing devices which then perform the beam-forming processing. In this case no transfer functions need to be applied to the microphone signals. Alternatively, when the further hearing devices each only have a single microphone, these can for instance be transmitted via the communication network to the user where a front and rear microphone signal is then generated from each of the transmitted microphone signals and provided to the hearing devices of the user. These front and rear microphone signals can also be generated at the fitter's site, and beam-forming can also be applied there so that again only two signals need to be transmitted. On the other hand beam-forming can be performed by the hearing devices of the user.

In a further embodiment of the proposed second method said one or two further hearing devices each comprises a canal microphone, and wherein said one or two further hearing devices are each positioned within an artificial ear canal, in particular of a dummy head, said dummy head being located at said virtual user location, wherein said picking up said voice of said fitter is performed by said canal microphones of said one or two further hearing devices at said first and/or second positions, and wherein said one or two hearing devices are worn by said user and are configured to reproduce the same sound as sensed in at least one corresponding artificial ear canal in at least one of the ear canals of said user.

In this way the fitter's voice is picked up very realistically in situations where an open fitting is employed, i.e. where the coupling of the hearing device to the ear canal is such that direct sound bypasses the hearing device and is not blocked from entering the ear canal, as is the case when a closed fitting is used, i.e. where the ear canal is essentially sealed. As a consequence a direct sound component present in the ear canal, which bypasses the processing of the hearing device, as well as a sound component picked up by the microphone(s) of the hearing device, which is then processed by the hearing device and then delivered into the ear canal, both need to be taken into account. The sound picked up by the canal microphone comprises both of these components. The signals from the canal microphones are subsequently transmitted to the user. Since the signals from the canal microphones contain the direct sound components which is not processed by the hearing device, the hearing loss compensating processing must be performed by the further hearing device. Otherwise, e.g. if it were carried out the hearing devices of the user, the direct sound components would also be affected by the processing. The function of the hearing devices during fitting in the present case is therefore merely to reproduce the two signals picked up by the ear canal microphones of the further hearing devices such that they exhibit the same sound levels in the ear canals of the user as in the artificial ear canals of the dummy head. In order to pick up the sound in the artificial ear canals of the dummy head accurately the coupling of the further hearing devices to the dummy head should be as similar as possible as the coupling of the hearing devices to the user's ear canals.

In yet another embodiment of the proposed second method at least one of said artificial ear canals is manufactured according to an ear impression or ear scan of said user and/or is selected from a multitude of prefabricated artificial ear canals in order to resemble an ear canal of said user.

In this way the direct sound component picked up by the canal microphone of the further hearing devices positioned within the artificial ear canals of the dummy head very closely matches the direct sound component that would be picked up the within the ear canals of the user if he/she were at the virtual user location. A close matching is essentially achieved when the rest volume between the end of the hearing device and the ear drum, i.e. the inner end of the ear canal, is approximately the same within the artificial ear canal of the dummy head.

In an embodiment of the proposed first or second methods said applying a hearing loss compensating signal processing is carried out by one or more of the following:

said one or two hearing devices;

a computing device in said first room;

a computing device in said second room;

if applicable, said further one or two hearing devices.

Depending on the processing capabilities available at the fitter's site and at the remote user's site the processing can thus be performed by appropriate means at either site or be suitably split between the two sites. Depending on where the processing takes place more or less signals/information need(s) to be transmitted from the fitter's site to the user's site.

In another embodiment of the proposed first and second methods said presenting said hearing loss compensated version of said voice of said fitter is carried out by one or more of the following:

said one or two hearing devices;

headphones, in particular closed headphones;

one or more room loudspeakers.

By providing the fitter's voice to the user via headphones the user does not have to have any hearing devices at his site during the fitting process. In this way it is possible to provide an impression of what hearing improvement can be achieved with hearing devices to a potential customer who is in the process of making up his mind whether to actually buy a (pair of) hearing device(s). Once such a customer has been convinced of the benefits the fitter can send him a correspondingly fitted (pair of) hearing device(s) without the customer ever having to visit the fitter's office. By presenting the fitter's voice using one or more room loudspeakers other people, such as a care giver or family member of the user can also hear what is going on during the fitting session, for instance to be able to help the user, e.g. when feedback to the fitter is required.

In a further embodiment of the proposed first or second methods said one or two hearing devices are located in said second room, or are sent to said user after adjustment of said hearing loss compensating signal processing.

In yet another embodiment the proposed first and second methods further comprise, if applicable, the step of writing parameters of said hearing loss compensating signal processing after adjustment of said hearing loss compensating signal processing to said one or two hearing devices.

The user can be wearing the hearing devices during the fitting procedure and the hearing devices may for instance be immediately adjusted during the fitting session. Alternatively, the user does not need to be wearing the hearing devices but can for instance use headphones, preferably closed headphones, during the fitting process. In this case the fitter can send the hearing device settings resulting from the fitting procedure to the user at the end of the fitting session via the communication network. On the other hand the fitter can for instance arrange a pair of hearing devices intended for the user at the dummy head (i.e. the further hearing devices are then actually the user's hearing devices), adjust the settings of these hearing devices, and once the user is satisfied with the selected settings based on his perception of the fitter's voice via the headphones, the fitter can send the correctly adjusted, i.e. the appropriately fitted hearing devices to the user.

In yet another embodiment of the proposed first and second methods said step of obtaining a feedback from said user comprises one or more of the following steps:

recording the voice of said user by one or more hearing device microphones of said one or two hearing devices;

recording the voice of said user by a telephone;

recording an image of said user by a video camera;

receiving text or command input of said user by a keyboard or touch-screen.

In yet another embodiment the proposed first and second methods further comprise the steps of:

picking up sounds present in said second room via at least one of the microphones of said one or two hearing devices, thus yielding at least one hearing device microphone signal; and evaluating the sound environment at said second room by analysing said at least one hearing device microphone signal.

In this way it can be determined whether the sound environment at the user's site is similar to the sound environment present at the fitter's site. If the two sound environments are too dissimilar the proposed methods will not achieve the intended effect for the user of perceiving the fitter's voice as though the user were present at the fitter's site.

In yet further embodiment of the proposed first and second methods said step of evaluating comprises assessing at least one of the following:

sound pressure level;

spectral level;

sound class;

reverberation time;

spatial distribution of background sounds.

These parameters can then be sent back to the fitter's site via the communication network in order to allow the fitter to quantitatively determine if the sound environment at the remote site of the user is sufficiently similar to allow successful application of the proposed methods. If a certain difference is determined either instructions can be provided to the user on how to change the sound environment or the fitter may change the sound environment at his site, e.g. by adjusting the sound level, for instance by increasing the loudness of his voice.

In yet another embodiment the proposed first and second methods further comprise the steps of:

- capturing a video signal of said fitter's face with a video camera;
- sending said video signal to said second room via the communication network; and
- outputting said video signal on a display in said second room.

The video camera is for instance located at the virtual user location in between the first and the second position at the fitter's site, and the display is located at a distance from the user's head which is approximately the same as the distance between the fitter and the virtual user location.

Such a visual representation of the fitter's face at the user's site further enhances the impression for the user that he/she is present at the fitter's site and increases the realistic perception of the fitter's voice for the user of the hearing devices.

It is expressly pointed out that any combination of the above-mentioned embodiments, or combinations of combinations, is subject of a further combination. Only those combinations are excluded that would result in a contradiction.

BRIEF DESCRIPTION OF THE DRAWINGS

For the purpose of facilitating the understanding of the present invention, exemplary embodiments thereof are illustrated in the accompanying drawings which are to be considered in connection with the following description. Thus, the present invention may be more readily appreciated. What is shown in the figures is the following.

DETAILED DESCRIPTION OF THE INVENTION

Figure 1:
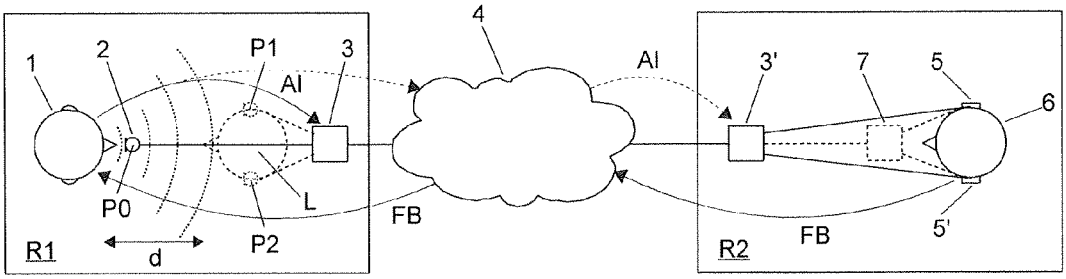
FIG. 1 shows in a schematic representation an exemplary set-up for carrying out the proposed first method according to the present invention for remotely fitting a pair of hearing devices where a distant user is wearing the hearing devices during the fitting process.

FIG. 1 illustrates a set-up in schematic representation for remote fitting of a user's hearing devices 5, 5'. Hereby, the fitter 1 is located at his office, i.e. in a room R1, and the user 6 of a hearing devices 5, 5' is distantly located from the fitter 1, for instance at home, i.e. in a room R2. For providing his voice to the distant user 6 the fitter 1 speaks into a microphone 2 arranged at a position P0 in close proximity to the fitter's mouth. An advantage of picking up the fitter's voice as close as possible to his mouth is that the sound of his voice then dominates over possibly interfering sounds from the surroundings. The microphone 2 can for instance be the microphone of a headset, such as a boom microphone, or it can be a desk microphone, attached to a microphone stand situated in front of the fitter 1 on a desk. The fitter's voice is picked up by the microphone 2 which converts the sound signal into an electrical signal which is then passed to a processing device 3. The processing device 3 can be any computational device capable of performing audio signal processing, such as for instance a personal computer (PC), a mobile telephone, or a portable digital assistant (PDA).

In order to generate a realistic impression of the fitter's voice to the user 6, the fitter's voice should ideally be presented in such a way that it appears to the user 6 as though the fitter's head is at a distance d, e.g. 1 m, in front of the user 6, i.e. that the user is located at a virtual user location L. To achieve this a first transfer function between the position P0 of the microphone 2 and a first position P1 located at a distance, e.g. at 1 m, from the microphone 2 in the fitter's surroundings is applied to the microphone signal in the processing device 3, thus yielding a first filtered microphone signal. By doing this the first filtered microphone signal includes the effect of the sound propagation from the position P0 of the microphone 2 to the first position P1. This first transfer function can for instance be selected from a multitude of predetermined transfer functions stored in a database, whereby these stored transfer functions were established based on such quantities as the distance from P0 to P1, i.e. the location of the virtual user location L within the room R1, room acoustics in R1 and microphone location effects as well as the characteristics of the microphone 2 and the microphones of the hearing devices.

Subsequently, the first filtered microphone signal is sent from the processing device 3 over a communication network 4 to the user 6. The communication network 4 can for instance be the Internet, a public switched telephone network (PSTN), or a mobile telecommunication network such as a GSM or UMTS network. Alternatively, the unprocessed microphone signal could be sent over the communication network 4 and the first transfer function could be applied subsequently in the processing device 3' at the site R2 of the user 6. The first filtered microphone signal is then delivered to the hearing devices 5, 5' of the user 6. In order to be able to directly receive the signal from the communication network 4, the hearing devices 5, 5' must include a built-in receiver for receiving signals from the type of communication network 4 used. Alternatively, the signal from the communication network 4 can be provided from the processing device 3' to the hearing devices 5, 5' via a hub 7 which relays signals from a long-haul link provided by the communication network 4 to a short-range link between the hub 7 and the hearing devices 5, 5', e.g. from a GSM link to a Bluetooth link. Such a hub 7 can for instance be a mobile phone. Moreover, further hubs may be used, e.g. for converting a standard Bluetooth signal to a proprietary inductive signal, such as is possible with Phonak's iCom communication interface device. In whatever way the first filtered microphone signal is delivered to the hearing devices 5, 5' it is then presented to the user 6 via the loudspeaker of each hearing device 5, 5'. The miniature loudspeakers frequently employed in ear-level hearing devices are commonly also referred to as "receivers".

In this way the loudness, timbre and intelligibility of the fitter's voice appear to the user as if he/she were situated at the fitter's site R1. The effectiveness of this effect however depends on whether the background sound level and sound spectrum at the user's site and at the fitter's site are similar as well as on the degree of sound coupling from the hearing devices 5, 5' to the user's ears. When the hearing devices 5, 5' strongly occlude the ear canals of the user 6, i.e. when the hearing devices 5, 5' substantially seal the ear canals and thus practically no sound from the environment of the user 6 reaches his ear drums, the user 6 will essentially perceive the fitter's voice as though he/she were present at the fitter's site R1.

When both hearing devices 5, 5' are outputting the same first filtered microphone signal the fitter's voice cannot be localised since the user 6 perceives the fitter's voice as being within his head. This negative effect can be mitigated by providing a second signal as follows. A second transfer function between the position P0 of the microphone 2 and a second position P2 located at a distance, e.g. at 1 m, from the microphone 2 in the fitter's surroundings is applied to the microphone signal in the processing device 3, thus yielding a second filtered microphone signal. By doing this the second filtered microphone signal includes the effect of the sound propagation from the position P0 of the microphone 2 to the second position P2. The first and second position P1, P2 should ideally be spaced apart by the distance between the ears of the user 6. The sound propagation from the microphone 2 to the first and second positions P1 and P2, respectively, will typically vary due to different propagation delays of the sound waves at the positions P1 and P2, respectively. Such differences are important for sound localisation since they are the source of binaural cues, i.e. differences in time of arrival (interaural time differences, ITDs) and level (interaural level differences, ILD) of hearing a sound at the left and right ear, to which the auditory system is very sensitive.

Subsequently, the second filtered microphone signal is also sent from the processing device 3 over the communication network 4 to the user 6. The sent first and second filtered microphone signals, respectively, are then delivered to the right and left hearing device 5 and 5', respectively, of the user 6, where they are output via the receiver of the right and left hearing device 5 and 5', respectively. By alternatively applying the second transfer function to the microphone signal after it has been sent over the communication network 4, i.e. at the user's site R2, only a single signal needs to be sent via the communication network 4.

Once the fitter's voice has been heard by the user 6, the user 6 can provide feedback FB regarding the perceived quality of the fitter's voice, e.g. in terms of loudness, timbre and intelligibility, to the fitter 1 via the communication network 4. Depending on the feedback FB the fitter 1 receives from the user 6 the fitter 1 can make adjustments to a hearing loss compensation signal processing. This hearing loss compensation signal processing can be applied to the microphone signal before or after applying the transfer function(s). Therefore, it can be carried out by the processing device 3 at the fitter's site R1, the processing device 3' at the user's site R2 or the hearing devices 5, 5' themselves. The fitter 1 changes the settings of the hearing loss compensation signal processing performed by one or possibly a combination of these devices by sending suitable adjustment instructions AI to them.

When adjustments have been made to the settings of the hearing loss compensation signal processing by means of suitable adjustment instructions AI by the fitter 1 the user 6 again provides feedback FB to the fitter 1 regarding his perception of the fitter's voice. This cycle is repeated until the user 6 and/or the fitter 1 is satisfied with the quality of the fitter's voice as perceived by the user 6.

Figure 2:
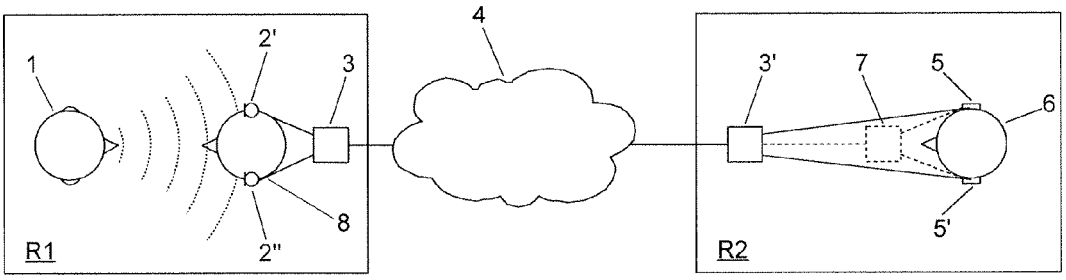
FIG. 2 shows in a schematic representation another exemplary set-up for carrying out further variants of the proposed first method according to the present invention.

In order to further improve the natural perception of the fitter's voice by the user 6 its localisation is enhanced by means of the exemplary set-up schematically illustrated in FIG. 2. Instead of picking up the fitter's voice close to his mouth, it is now picked up by two microphones 2', 2" which are positioned at a distance from the fitter 1, e.g. 1 m in front of him, and spaced apart by the distance between the ears of the user 6. A possible disadvantage here is that in certain sound environments competing sounds from the surroundings may interfere and potentially even dominate over the fitter's voice. If the microphones 2', 2" were positioned in free space a transfer function would be applied to each of them in order to take into account, i.e. to simulate, the shaping of the frequency spectrum of the sound waves caused by the presence of the missing head at the virtual user location L. To maximise the achievable localisation the first and second microphones 2', 2" should be mounted at a dummy head 8, preferably inset in ear-shaped moulds. By using a dummy head 8, such as for instance a KEMAR manikin, the signals picked up by the first and second microphone 2' and 2" incorporate the sound-shadowing effect caused by the head and fully capture the influences on the sound frequency spectrum that result from sound waves impinging upon the head, the conchas and the entrance to the ear canals (i.e. take into account the head-related transfer functions, HRTFs). This leads to a better externalisation of the fitter's voice for the user 6 of the hearing devices 5, 5'. Transfer functions may still need to be applied to the signals of the microphones 2', 2" in order to take account of the different characteristics of the two microphones 2', 2" and the microphones in the hearing devices 5, 5'.

Figure 3:
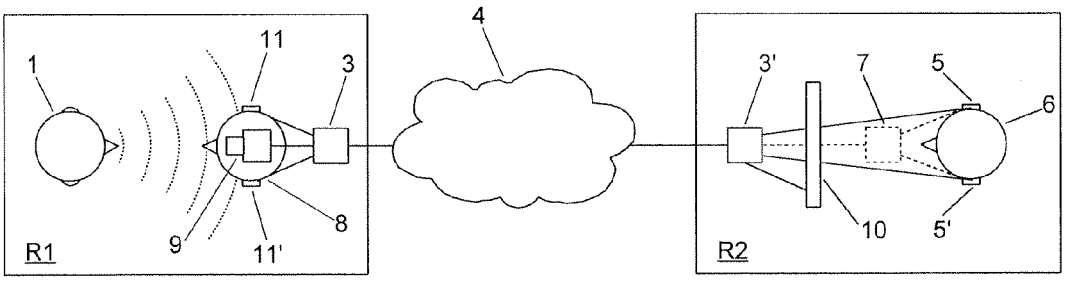
FIG. 3 shows in a schematic representation an exemplary set-up for carrying out the proposed second, alternative method according to the present invention for remotely fitting a pair of hearing devices where a distant user is wearing the hearing devices during the fitting process which includes a visual presentation of the fitter's face to the user.

Alternatively, instead of employing the microphones 2', 2" for picking up the fitter's voice, a further pair of hearing devices 11, 11' is used as schematically depicted in FIG. 3. The pair of hearing devices 11, 11' is again arranged at a dummy head 8. In order to provide a realistic impression to the user 6 of the fitter's voice and make it appear to the user 6 as though he/she were located at the fitter's site R1 the coupling of the further hearing devices 11, 11' to the artificial ear canals of the dummy head 8 should be as similar as possible to the coupling of the hearing devices 5, 5' to the user's ear canals. Furthermore the microphones used in the further hearing devices 11, 11' should have the same characteristics as those employed in the hearing devices 5, 5'.

In the set-up according to FIG. 3 not only the fitter's voice is provided to the user 6 but also a video image of the fitter's face is captured by a video camera 9 and sent to the user 6 where it is reproduced on a display 10 such as a video screen. The set-up should be such that the camera 9 is located in between the two further hearing devices 11, 11' at eye-level of the fitter 1. Accordingly, the display 10 should be at the same distance from the user 6 as the camera 9 is displaced from the fitter 1. Simultaneously presenting the video image and the voice of the fitter 1 to the user 6 creates a more realistic perception of the fitter's voice to the user 6 and increases the "illusion" that the user 6 is sitting face-to-face with the fitter 1 at the fitter's site R1.

In cases where the hearing devices 5, 5' do not strongly occlude the ear canals of the user 6, i.e. if a considerable amount of direct sound from the surroundings of the user 6 reaches the user's ear drums, as is the case when using so-called "open fitted" hearing devices, the fitter's voice is preferably picked up by ear canal microphones provided in the further hearing devices 11, 11' and arranged within the artificial ear canals of the dummy head 8. In this case the hearing loss compensating signal processing must be performed by the further hearing devices 11, 11', so the fitting adjustment instructions AI are exclusively applied to the further hearing devices 11, 11'. The signals picked up by the canal microphones of the further hearing devices 11, 11' are subsequently sent via the communication network 4 to the user 6. The function of the processing units 3 & 3', respectively, is then merely to send and receive, respectively, the two canal microphone signals which are subsequently reproduced by the receivers of the hearing devices 5, 5' in such a way that the sound levels in the ear canals of the user 6 are the same as the sound levels picked up in the artificial ear canals of the dummy head 8. However, in this situation the hearing devices 5, 5' do not perform hearing loss compensating processing or accept fitting adjustment instructions AI during the fitting session. Once the settings of the further hearing devices 11, 11' have been adjusted such that the user 6 and/or the fitter 1 is satisfied with the hearing loss compensating signal processing, these settings can be transferred to the hearing devices 5, 5', e.g. via the communication network 4.

Figure 4:
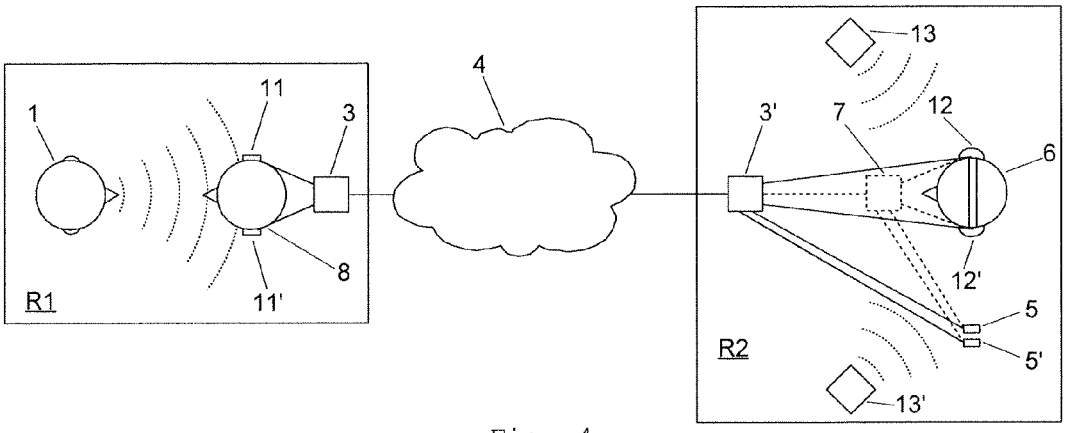
FIG. 4 shows in a schematic representation a further exemplary set-up for carrying out the proposed methods according to the present invention where the user is wearing headphones and/or where the fitter's voice is being presented via room loudspeakers.

A further exemplary set-up is schematically depicted in FIG. 4. Here the fitting session is performed whilst the user 6 is wearing closed headphones 12, 12' instead of his hearing devices 5, 5'. The fitter's voice is picked up by the further hearing devices 11, 11' which in this case are the same as the user's hearing devices. Depending on the kind of coupling of the further hearing devices 11, 11' the hearing loss compensating signal processing is either performed by the further hearing devices 11, 11' (e.g. in the case of open fitted hearing devices), by the processing device 3 at the fitter's site R1 or by the processing device 3' at the user's site R2, or possibly split amongst two or more of these. The processed signals are subsequently output via the loudspeakers of the closed headphones 12, 12'. If the hearing loss compensating signal processing is carried out by the processing device 3' at the user's site R2 a data link in required via the communication network 4 to allow the fitter 1 to control the processing device 3', i.e. to provide fitting adjustment instructions AI to it. The processing device 3' can for example be a personal computer (PC) to which a hearing device emulation program is uploaded from the fitter's site R1 via the communication network 4. The fitter 1 can then remote control the PC at the user's site R2 and thus has full command over the hearing device emulation program. The output signals can alternatively be output to the user 6 via room loudspeakers. This has the advantage that other people, such as someone taking care of the user 6, can also perceive the fitter's voice and be aware of what is going on during the fitting session, in case such a person needs to assist the user 6, e.g. in providing feedback FB to the fitter 1. During the fitting session the fitter 1 adjusts the settings of the hearing loss compensating signal processing by providing adjustment instructions AI to the devices which are executing this processing. Once the user 6 and/or the fitter 1 is satisfied with the sound quality and intelligibility for instance of the fitter's voice the settings are uploaded to the user's hearing devices 5, 5' either directly from the processing device 3' located at the user's site R2, e.g. by means of cables, or for instance via a hub 7, e.g. wirelessly for instance via a Bluetooth link. A mechanism for downloading software to a hearing device over a network is disclosed in WO 02/35884 A2. Subsequently, the user 6 can replace the headphones 12, 12' with the hearing devices 5, 5' and for instance check the quality of the fitter's voice now wearing the hearing devices 5, 5' using a set-up according to one of the FIGS. 1 to 3.

The hearing device 5, 5' could also be located at a third site, e.g. a hearing device distributor's site, to which the settings can be uploaded from the fitter's site R1 via the communication network 4. The hearing device distributor would then load the received settings into the hearing devices 5, 5' and subsequently send the hearing devices 5, 5' to the user 6 ready for immediate use. Alternatively, adjustments of the user's hearing devices 5, 5' can also be performed directly with one of the set-ups according to FIGS. 1 to 3, whereby an additional control link is required via the communication network 4 so that the fitter 1 can adjust the settings of the hearing devices 5, 5'.

In order to make sure that the acoustic surroundings at the user's site R2 are suitable for accurately and realistically presenting the fitter's voice to the user 6, the fitter 1 can initiate a test, e.g. at the beginning of a fitting session, which evaluates the sound environment at the user's site R2 by for instance determining sound pressure levels, spectral levels, sound classes, etc. This can be done for instance with the user's hearing devices 5, 5' by picking up the surrounding sound with one or more of the microphones of the hearing devices 5, 5' and subsequently analysing the audio signal with the signal processing unit within the hearing devices 5, 5'. The hearing devices 5, 5' are capable of performing the necessary audio signal analyse since this kind of analysis is typically also performed during normal operation of the hearing devices 5, 5', e.g. to determine the most appropriate signal processing strategy in the prevailing listening situation, hence allowing the automatic selection of the most appropriate hearing program or signal processing parameters. In order to perform such a test a data link must be established over the communication network 4 via which the fitter 1 can control at least one of the hearing devices 5, 5', e.g. to start the test, and then to download data such as analysis results from the hearing devices 5, 5'.

What is claimed is:

1. A method for fitting one or two hearing devices (5, 5'), wherein a fitter (1) is in a first room (R1) and a user (6) of said one or two hearing devices (5, 5') is in a second room (R2) being distant from said first room (R1), and wherein in said first room (R1) there is a virtual user location (L) at a distance (d) in a range of 0.5 m to 5 m from said fitter (1), said method comprising the steps of:

picking up a voice of said fitter (1) in said first room (R1);

transmitting said voice of said fitter (1) to said second room (R2) via a communication network (4);

applying a hearing loss compensating signal processing to said voice of said fitter (1) before or after said transmission thereby obtaining a hearing loss compensated version of said voice of said fitter (1);

applying a voice rendering signal processing to the voice of said fitter (1) before or after said transmission and before or after said hearing loss compensating signal processing, said voice rendering signal processing comprising applying at least one transfer function selected from a multitude of transfer functions and rendering said voice of said fitter (1) such that it is perceived by said user (6) as if said user (6) were at said virtual user location (L) wearing said one or two hearing devices (5, 5');

presenting said hearing loss compensated version of said voice of said fitter (1) to said user (6) in said second room (R2);

obtaining a feedback (FB) from said user (6), said feedback (FB) being indicative of how said hearing loss compensated version of said voice of said fitter (1) was perceived by said user (6);

transmitting said feedback (FB) to said first room (R1) via said communication network (4) and presenting said feedback (FB) to said fitter (1);

obtaining an adjustment instruction (AI) from said fitter (1);

adjusting said hearing loss compensating signal processing according to said adjustment instruction (AI);

repeating the preceding steps until said fitter (1) or said user (6) is satisfied with said hearing loss compensating signal processing.

2. The method of claim 1, wherein said picking up said voice of said fitter (1) is performed at a position (P0) in close proximity to said fitter's mouth.

3. The method of claim 1, wherein said picking up said voice of said fitter (1) is performed at said virtual user location (L) at a first position (P1) where a first ear of said user (6) would be if said user (6) were present in said first room (R1) at said virtual user location (L) or at a second position (P2) where a second ear of said user (6) would be if said user (6) were present in said first room (R1) at said virtual user location (L).

4. The method of claim 3, wherein said picking up said voice of said fitter (1) is performed by at least one microphones (2', 2") at said first or second position (P1, P2), the at least one microphones (2', 2") being located in a free field, on one or both sides of a Jecklin disk, or at or in one or both ears of a dummy head (8).

5. The method of claim 1, further comprising the steps of:

measuring or calculating transfer functions for different hearing devices, acoustic couplings, distances (d) between fitter (1) and virtual user location (L) or room acoustics;

storing said transfer functions in a database;

providing data from said database for use in said voice rendering signal processing.

6. The method of claim 5, wherein said step of measuring or calculating transfer functions comprises one or more of the following sub-steps:

measuring a microphone location effect;

estimating an attenuation for a particular distance (d) between fitter (1) and virtual user location (L);

measuring a room acoustics, in particular by measuring an impulse response.

7. The method of claim 5, wherein said one or two hearing devices (5, 5') each comprises a rear and a front microphone, wherein one of the following applies:

said voice rendering signal processing comprises generating a first signal which replaces a front microphone signal derived from said front microphone and a second signal which replaces a rear microphone signal derived from said rear microphone, wherein said hearing loss compensating signal processing comprises a beam-forming processing;

said hearing loss compensating signal processing is operated in an omni-directional mode which does not differentiate between said front and rear microphone signals, at least whenever said voice of said fitter is presented.

8. A method for fitting one or two hearing devices (5, 5'), wherein a fitter (1) is in a first room (R1) and a user (6) of said one or two hearing devices (5, 5') is in a second room (R2) being distant from said first room (R1), and wherein in said first room (R1) there is a virtual user location (L) at a distance (d) in a range of 0.5 m to 5 m from said fitter (1), said method comprising the steps of:

picking up a voice of said fitter (1) in said first room (R1) by at least one microphone (2', 2") of one or two further hearing devices (11, 11') located at said virtual user location (L) at a first position (P1) where a first of said one or two hearing devices (5, 5') being worn by said user (6) would be if said user (6) were present in said first room (R1) at said virtual user location (L) or at a second position (P2) where a second of said one or two hearing devices (5', 5) being worn by said user (6) would be if said user (6) were present in said first room (R1) at said virtual user location (L);

transmitting said voice of said fitter (1) to said second room (R2) via a communication network (4);

applying a hearing loss compensating signal processing to said voice of said fitter (1) before or after said transmission thereby obtaining a hearing loss compensated version of said voice of said fitter (1);

presenting said hearing loss compensated version of said voice of said fitter (1) to said user (6) in said second room (R2);

obtaining a feedback (FB) from said user (6), said feedback (FB) being indicative of how said hearing loss compensated version of said voice of said fitter (1) was perceived by said user (6);

transmitting said feedback (FB) to said first room (R1) via said communication network (4) and presenting said feedback (FB) to said fitter;

obtaining an adjustment instruction (AI) from said fitter (1);

adjusting said hearing loss compensating signal processing according to said adjustment instruction (AI);

repeating the preceding steps until said fitter (1) or said user (6) is satisfied with said hearing loss compensating signal processing.

9. The method of claim 8, wherein said one or two further hearing devices (11, 11') are at said first or second position (P1, P2) located in a free field, on one or both sides of a Jecklin disk, or at or in one or both ears of a dummy head (8).

10. The method of claim 8, wherein said one or two hearing devices (5, 5') each comprises a front and a rear microphone, wherein one of the following applies:

said one or two further hearing devices (11, 11') each comprises a front and a rear microphone by which said voice of said fitter (1) is picked up, wherein said hearing loss compensating signal processing comprises a beam-forming processing;

said one or two further hearing devices (11, 11') each comprises only one microphone by which said voice of said fitter (1) is picked up, wherein a front and a rear microphone signal is simulated by an appropriate filtering, wherein said hearing loss compensating signal processing comprises a beam-forming processing;

said hearing loss compensating signal processing is operated in an omni-directional mode which does not differentiate between said front and rear microphone signals, at least whenever said voice of said fitter (1) is presented.

11. The method of claim 8, wherein said one or two further hearing devices (11, 11') each comprises a canal microphone, and wherein said one or two further hearing devices are each positioned within an artificial ear canal, in particular of a dummy head, said dummy head being located at said virtual user location (L), wherein said picking up said voice of said fitter (1) is performed by said canal microphones of said one or two further hearing devices (11, 11') at said first or second positions (P1, P2), and wherein said one or two hearing devices (5, 5') are worn by said user (6) and are configured to reproduce the same sound as sensed in at least one corresponding artificial ear canal in at least one of the ear canals of said user (6).

12. The method of claim 11, wherein at least one of said artificial ear canals is manufactured according to an ear impression or ear scan of said user (6) or is selected from a multitude of prefabricated artificial ear canals in order to resemble an ear canal of said user (6).

13. The method according to claim 1, wherein said applying a hearing loss compensating signal processing is carried out by one or more of the following:

said one or two hearing devices (5, 5');

a processing device (3) in said first room (R1);

a processing device (7) in said second room (R2);

if applicable, said further one or two hearing devices.

14. The method according to claim 1, wherein said presenting said hearing loss compensated version of said voice of said fitter (1) is carried out by one or more of the following:

said one or two hearing devices (5, 5');

headphones (12, 12'), in particular closed headphones;

one or more room loudspeakers (13, 13').

15. The method according to claim 1, wherein said one or two hearing devices (5, 5') are located in said second room (R2), or are sent to said user (6) after adjustment of said hearing loss compensating signal processing.

16. The method of claim 1 further comprising, if applicable, the step of writing parameters of said hearing loss compensating signal processing after adjustment of said hearing loss compensating signal processing to said one or two hearing devices (5, 5').

17. The method of claim 1, wherein said step of obtaining a feedback (FB) from said user (6) comprises one or more of the following steps:

recording the voice of said user (6) by one or more hearing device microphones of said one or two hearing devices (5, 5');

recording the voice of said user (6) by a telephone;

recording an image of said user (6) by a video camera;

receiving text or command input of said user (6) by a keyboard or touch-screen.

18. The method of claim 1 further comprising the steps of:

picking up sounds present in said second room (R2) via at least one of the microphones of said one or two hearing devices (5, 5'), thus yielding at least one hearing device microphone signal; and evaluating the sound environment at said second room (R2) by analysing said at least one hearing device microphone signal.

19. The method of claim 18, wherein said step of evaluating comprises assessing at least one of the following:

sound pressure level;

spectral level;

sound class;

reverberation time;

spatial distribution of background sounds.

20. The method of claim 1, further comprising the steps of:

capturing a video signal of said fitter's face with a video camera (9);

sending said video signal to said second room (R2) via the communication network (4); and outputting said video signal on a display (10) in said second room (R2).

* * * * *